US006742215B2

(12) United States Patent
Panfili et al.

(10) Patent No.: US 6,742,215 B2
(45) Date of Patent: Jun. 1, 2004

(54) ERGONOMIC DRYWALL KNIFE

(75) Inventors: Jean-Pierre Panfili, Berthierville (CA); François Panfili, Berthierville (CA); Istvan Vaskuthy, St-Hyacinthe (CA)

(73) Assignee: A. Richard S.E.N.C., Montreal (CA)

( * ) Notice: Subject to any disclaimer, the term of this patent is extended or adjusted under 35 U.S.C. 154(b) by 398 days.

(21) Appl. No.: 09/776,729

(22) Filed: Feb. 6, 2001

(65) Prior Publication Data

US 2002/0104182 A1 Aug. 8, 2002

(51) Int. Cl.[7] ..... B05C 17/10; A47L 13/02

(52) U.S. Cl. ..... 15/236.01; 15/245.1; 15/235.4; 15/143.1; 30/169

(58) Field of Search ..... 16/110.1, 111.1, 16/110 R; 81/177.1, 490, 77.1, 489; 15/245.1, 143.1, 235.4, 236.01; 30/169, 340

(56) References Cited

U.S. PATENT DOCUMENTS 4,481,690 A * 11/1984 Simmons ..... 15/236.02
4,914,776 A * 4/1990 Kaye ..... 15/104.33
4,979,300 A * 12/1990 Blank et al. ..... 30/169
5,615,445 A 4/1997 Kelsay et al. ..... 15/245.1
5,850,663 A * 12/1998 Hardy et al. ..... 15/236.01
5,956,799 A 9/1999 Panaccione et al. ..... 15/236.01
5,996,231 A * 12/1999 Roche et al. ..... 30/169
2002/0004963 A1 * 1/2002 Woodnorth et al. ..... 15/160

* cited by examiner

*Primary Examiner*—Robert J. Warden, Sr.
*Assistant Examiner*—S Balsis
(74) *Attorney, Agent, or Firm*—Collard & Roe, P.C.

(57) ABSTRACT

A drywall knife having a handle and a blade securely mounted thereon. The handle includes an elongated inner core having a longitudinal axis, a transverse axis, a front end, a rear end and first and second opposite surfaces extending from the rear end to the front end of the inner core along the longitudinal axis of the handle, the blade being securely mounted to the front end of the inner core. The improvement resides in that the inner core of the handle includes at least one recess having an opening facing the first surface so as to reduce the overall weight of the drywall knife, and the inner core further includes a lid hingedly mounted to the first surface of the inner core, said lid being positioned and sized to be folded about an axis parallel to the longitudinal axis of the inner core so as to cover each recess. The drywall knife is inherently lightweight due to its design. The drywall knife is mounted onto the blade without the use of fasteners, due to the design of the handle and blade. The drywall knife has an ergonomic handle enabling comfortable and multiple hand gripping. The handle is manufactured by a moulding process which is capable of producing a sign on the handle of the drywall knife while the handle is moulded, the sign lasting all throughout the working life of the drywall knife handle.

19 Claims, 4 Drawing Sheets

ERGONOMIC DRYWALL KNIFE

FIELD OF THE INVENTION

The present invention relates to a drywall knife.

More particularly, the present invention relates to an ergonomic drywall knife for use in drywall applications and the like, said drywall knife comprising an ergonomic rubberized handle which is lightweight, enables comfortable and multiple hand gripping and has a long-lasting logo. Furthermore, the blade of the drywall knife is mounted to the handle without the use of fasteners.

BACKGROUND OF THE INVENTION

Drywall knives are very well known in the art. They generally consist of a manipulative handle onto which a blade is securely mounted. The drywall knife can be used by workers to carry out various tasks on drywall and the like. The blade is usually mounted onto the handle by means of fasteners such as bolts and nuts and/or rivets. This is a costly way of manufacturing and assembling drywall knives since using fasteners calls for added parts and added assembly steps. Therefore, it would be useful to provide a drywall knife whose blade is mounted onto the handle without the use of fasteners.

It is also known in the art that workers employing drywall knives usually work for long periods of time and the nature of their work requires them to have their arms in a usually extended manner so as to be able to carry out their tasks on drywalls and the like. Furthermore, they often need to use their drywall knives in order to plaster and smooth out drywall with a usually thick and heavy pastelike mixture, this too being also very tiring on the workers' arms. Therefore, it would be very useful to provide a drywall knife which is inherently lightweight due to its design.

It is also known in the art that these same workers need to use drywall knives in order to cut, plaster, or finish drywalls and the like, and the various tasks needed to be carried out often require the drywall knives to be manually gripped by the workers in different manners. However, most of the drywall knives in the art are of unwieldy nature because of their shape and size, having often rough edges, which make handling of the drywall knives cumbersome and/or strenuous on workers' hands. Therefore, it would be very useful to provide a drywall knife with an ergonomic handle enabling comfortable and multiple hand gripping.

It is further known in the art that manufactures often display information on the products they sell by means of labels secured to these same products or by simply printing the information onto the products. However, very often, the labels are deteriorated or become detached and the prints fade out after a while. Furthermore, this additional step of having to label a product after it has been manufactured constitutes additional costs. Therefore, it would be very useful to provide a drywall knife having a handle which is manufactured by a molding process which is capable of producing a sign on the handle of the drywall knife while the handle is molded, said sign lasting all throughout the working life of the drywall knife handle.

U.S. Pat. No. 5,956,799 granted on Sep. 28$^{th}$, 1999 to Panaccione et al. describes an ergonomic putty knife and scraper handle manufactured from at least two different hardness injection molded polymers having a plurality of harder longitudinal ribs embedded in a softer overlay but exposed on both top and bottom surfaces in strategic locations. The longitudinal ribs provided non-binding contact with fabric surfaces to ease the insertion and removal of the handle into and from a user's pocket for temporary storage of the tool when not in use. When employing the tool for its intended purpose, however, the user enjoys the comfort, efficiency and safety of an ergonomic handle offering a "soft touch" to thumb and fingers in those locations requiring superior grippability.

U.S. Pat. No. 5,615,445 granted on Apr. 1$^{st}$, 1997 to Kelsay et al. describes a taping knife which includes a blade with an elongated handle secured to the blade. The plastic handle includes a durable inner member and a grippable outer core. The hollow inner member is formed from adjoining member halves which have an inner structural support network of ribs. The handle component parts sealably interlock and are secured together upon formation of the outer grippable core whose material flows into certain ribbed network compartments and secures the interlocking parts together.

U.S. Pat. No. 5,850,663 granted on Dec. 22$^{nd}$, 1998 to Hardy et al. describes an ergonomic handle for a spreading tool designed to permit and encourage the user to grasp the handle with his/her fore and middle fingers extended onto the blade. The extended fingers are fully supported by an arch in the head of the handle, which combined with its comfortable gripping portion for the palm, thumb, ring and little fingers, allows proper alignment of the wrist and increased leverage on the blade while working the tool, yet minimizes fatigue, pain and the potential for injury.

None of the above-mentioned patents disclose or suggest an ergonomic drywall knife which is inherently lightweight due to its design and whose blade is mounted onto the handle without the use of fasteners, while enabling comfortable and multiple hand gripping and displaying a long-lasting logo.

SUMMARY OF THE INVENTION

The main objects of the present invention are to provide a drywall knife which satisfies each of the above-mentioned needs.

More particularly, a first object of the invention is to provide an ergonomic drywall knife which is inherently lightweight due to its design.

A second object of the invention is to provide an ergonomic drywall knife whose blade is mounted onto the handle without the use of fasteners, due to the design of the handle and blade.

A third object of the invention is to provide an ergonomic drywall knife having an ergonomic handle enabling comfortable and multiple hand gripping.

A fourth object of the invention is to provide an ergonomic drywall knife having a handle which is manufactured by a molding process which is capable of producing a sign on the handle of the drywall knife while said handle is molded, said sign lasting all throughout the working life of the drywall knife handle.

In accordance with the invention, the above objects are achieved by an improved drywall knife of the type comprising a handle having an elongated inner core comprising a longitudinal axis, a transverse axis, a front end, a rear end and first and second opposite surfaces extending from the rear end to the front end of the inner core along the longitudinal axis thereof. The drywall knife further comprises a blade securely mounted to the front end of the inner core.

This drywall knife is improved in that the inner core of the handle comprises at least one recess having an opening facing the first surface so as to reduce the overall weight of the drywall knife, and the inner core further comprises a lid hingedly mounted to the first surface of the inner core, the lid being positioned and sized to be folded about an axis parallel to the longitudinal axis of the inner core so as to cover the at least one recess. Such a feature makes the drywall knife lightweight.

Preferably, the front end of the inner core is provided with a slit extending along the transversal axis of the inner core. The slit preferably comprises two shoulders extending parallel to the longitudinal axis of the inner core and defining an insertion slot into which the blade of the drywall knife is securely inserted. The blade of the drywall knife preferably consists of a thin plate having an edge provided with a fishbone comprising tooth edges. The fishbone is devised to be inserted into the insertion slot at the front end of the inner core so that when the fishbone is inserted into the slot, the tooth edges grip into the shoulders and prevent the blade from being removed from the inner core of the drywall knife. This feature permits to mount the blade onto the handle without the use of fasteners.

Preferably also, the inner core with the lid in folded position is covered with a covering material so as to facilitate hand gripping of the drywall knife. Furthermore, the front end of the inner core is preferably slanted onto the blade in such a manner that a user of the drywall knife can rest his or her hand onto the front end of the inner core and onto the blade in a substantially flat manner. Moreover, the inner core preferably comprises a first finger support portion adjacent the front end of the handle on one of the first and second opposite surfaces of the inner core for supporting at least one extended finger of the user's hand holding the drywall knife. Preferably also, the inner core further comprises a second finger support portion adjacent the front end of the handle on the other one of the first and second opposite surfaces for supporting at least one other extended finger of the user's hand. Preferably also, each finger support portion respectively comprises two finger-shaped recessed cavities, each finger-shaped recessed cavity being used for optionally supporting a user's finger when holding the drywall knife. The above-mentioned features are primarily intended to allow for a more comfortable hand grip and also to enable various hand grips of the drywall knife. This gives to the drywall knife an ergonomic handle enabling comfortable and multiple hand gripping.

Preferably also, the second surface of the inner core of the handle is provided with a protuberance comprising an outer surface having at least one groove in the shape of a sign. Preferably also, the second surface further comprises at least one channel leading within the inner core to the at least one groove, such that when the inner core is covered with the covering material, the outer surface of the protuberance is not covered by the covering material and thus remains visible and the at least one channel and the at least one groove of the second surface of the inner core are both filled-up with the covering material to produce the at least one sign on the outer surface of the protuberance of the second surface. The sign on the protuberance of the second surface is preferably selected from a group consisting of names, words, numbers, logos, trademarks and symbols conveying information. This feature permits to manufacture the handle by a molding process which is capable of producing a sign on the handle of the drywall knife while the handle is molded, the sign lasting all throughout the working life of the drywall knife handle.

The invention and its advantages will be better understood by reading the following non-restrictive description of a preferred embodiment thereof, made with reference to the accompanying drawings.

DETAILED DESCRIPTION OF A PREFERRED EMBODIMENT OF THE INVENTION

Figure 1:
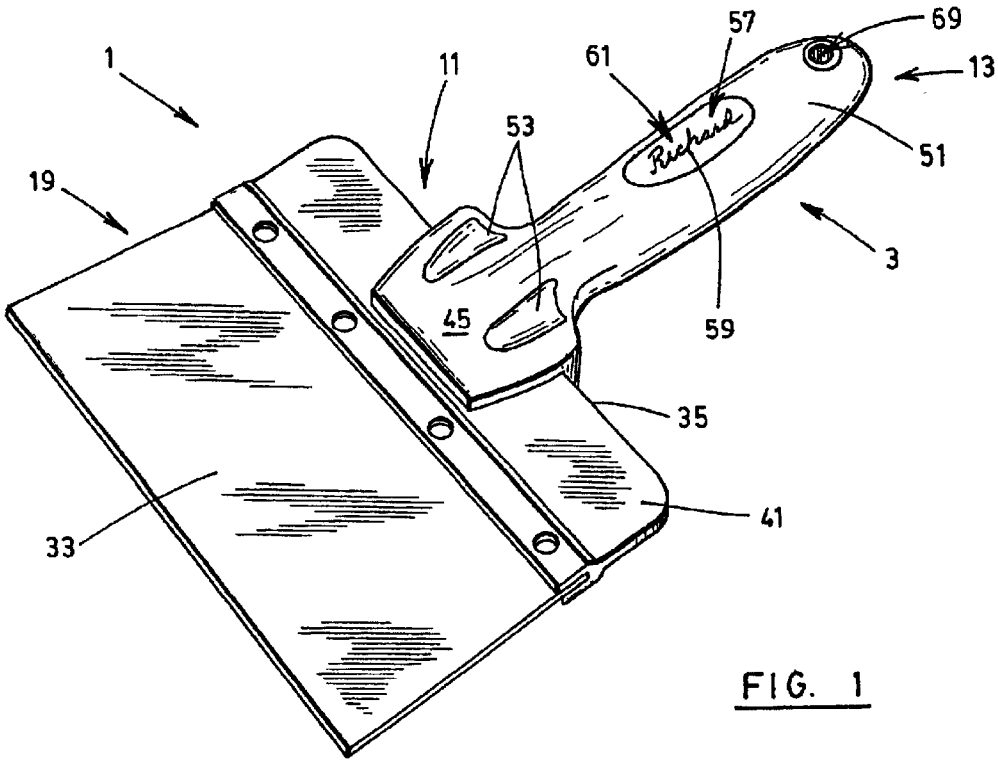
FIG. 1 is a perspective view of the ergonomic drywall knife according to a preferred embodiment of the invention.

In the following description, the same numerical references refer to similar elements. Moreover, although the present invention was primarily designed for a drywall knife, it could be used with other types of tools and/or objects of different fields, e.g. with putty knives, paint scrapers, drywall saws, ping-pong rackets, etc., as apparent to a person skilled in the art. For this reason, expressions such as "drywall knife" and/or "blade" and any other references and/or other expressions equivalents thereto should not be taken as to limit the scope of the present invention and include all other objects with which the present invention could be used.

The ergonomic drywall knife 1 according to the preferred embodiment of the invention shown in the accompanying drawings comprises a handle 3 having an elongated inner core 5 comprising a longitudinal axis 7, a transverse axis 9, a front end 11, a rear end 13 and first and second opposite surfaces 15, 17 extending from the rear end 13 to the front end 11 of the inner core 5 along the longitudinal axis 7 thereof. The drywall knife 1 further comprises a blade 19 securely mounted to the front end 11 of the inner core 5.

In accordance with the invention, the inner core 5 of the handle 3 comprises at least one recess 21 having an opening facing the first surface 15 so as to reduce the overall weight of the drywall knife 1, and the inner core 5 further comprises a lid 23 hingedly mounted to the first surface 15 of the inner core 5, the lid 23 being positioned and sized to be folded about an axis 25 parallel to the longitudinal axis 7 of the inner core 5 so as to cover the at least one recess 21.

Preferably, the inner core 5 is made of one single material. Preferably also, the inner core 5 is obtained through molding in such a manner that the front end 11, rear end 13, first and second opposite surfaces 15, 17, and lid 23 are integral to one another, that is, are made of a single piece. It is worth noting however that the lid 23 and/or any other component of the inner core 5 may be operatively affixed to the latter by other suitable means, such as fasteners for example, as apparent to a person skilled in the art, without departing from the scope of the present invention. For illustrative purposes thereof only, the lid 23 may be mounted to the inner core 5 by means of an actual hinge, for example.

Figure 5:
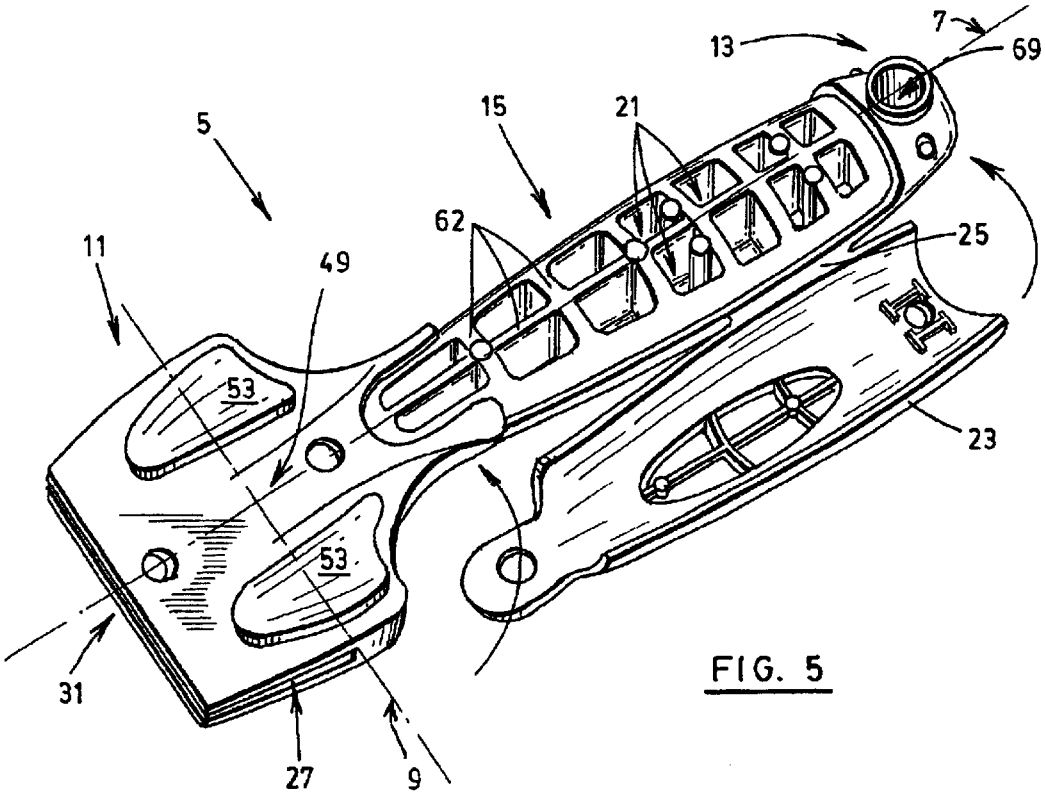
FIG. 5 is a perspective top view of the inner core of the handle of the drywall knife shown in FIG. 1, said inner core being shown with the lid open.
Figure 6:
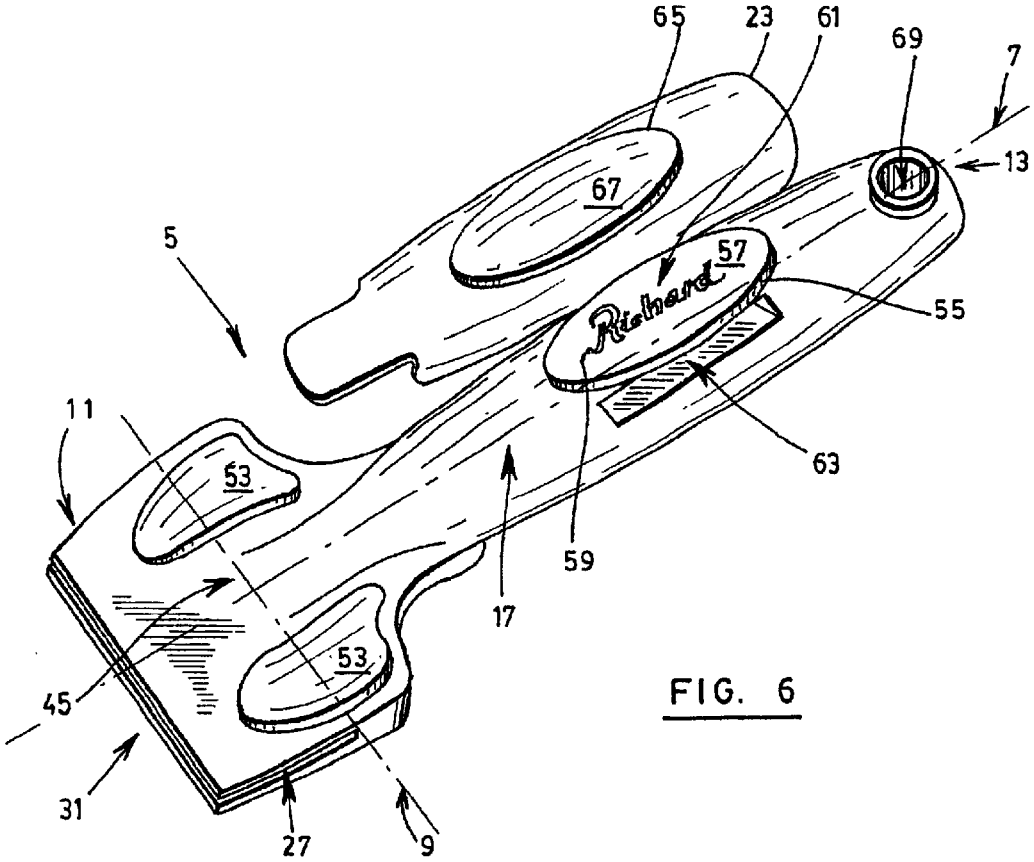
FIG. 6 is a perspective view of what is shown in FIG. 5.
Figure 7:
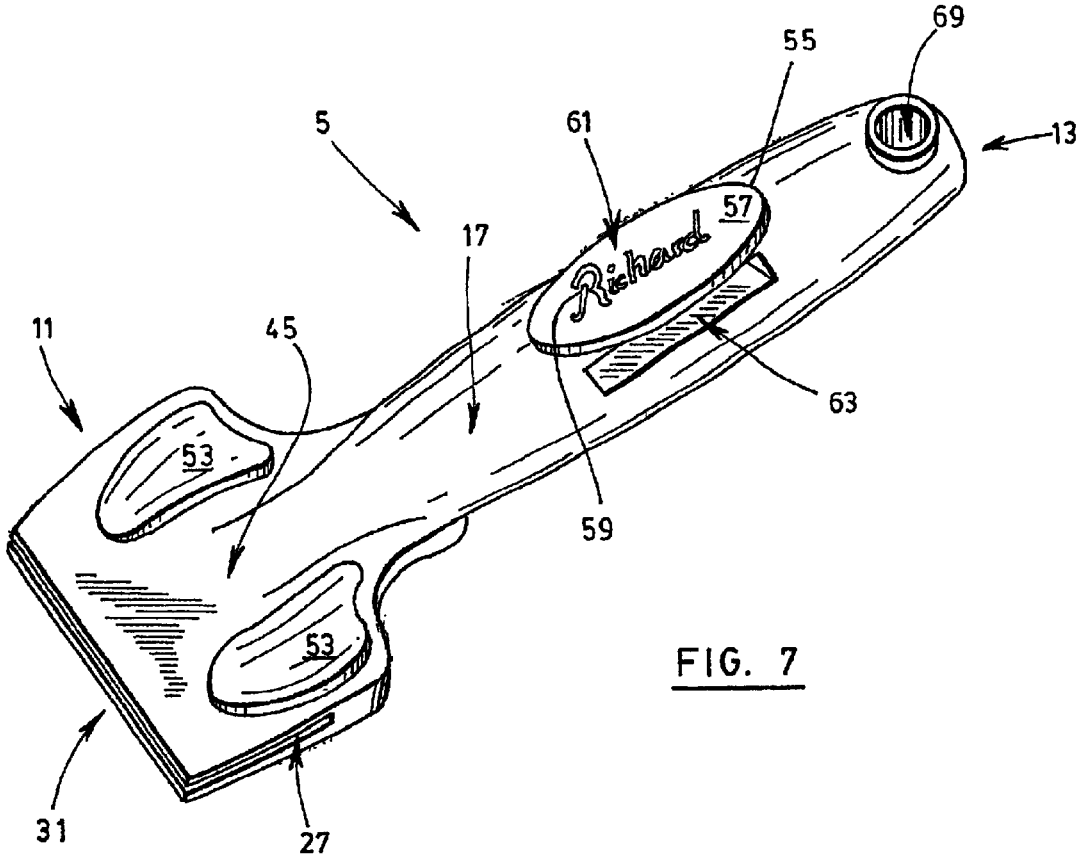
FIG. 7 is a perspective view of what is shown in FIG. 6, the inner core being shown with the lid closed thereon.

As better shown in FIGS. 5 to 7, the front end 11 of the inner core 5 is preferably provided with a slit 27 extending along the transversal axis 9 of the inner core 5. The slit 27 preferably comprises two shoulders 29 extending parallel to the longitudinal axis 7 of the inner core 5 and defining an insertion slot 31 into which the blade 19 of the drywall knife 1 is securely inserted.

As better shown in FIGS. 1 to 4, the blade 19 of the drywall knife 1 preferably consists of a thin plate 33 having an edge 35 provided with a fishbone 37 comprising toothed edges 39. The fishbone 37 is devised to be inserted into the insertion slot 31 at the front end 11 of the inner core 5 so that when the fishbone 37 is inserted into the slot 31, the toothed edges 39 grip into the shoulders 29 and prevent the blade 19 from being removed from the inner core 5 of the drywall knife 1.

It is worth noting that the handle 3 and blade 19 could also be secured to one another by other suitable means if need be, as apparent to a person skilled in the art, such as fasteners, insert-molding of the handle 3 onto the blade 19, press fitting, or friction retention, for example.

Figure 4:
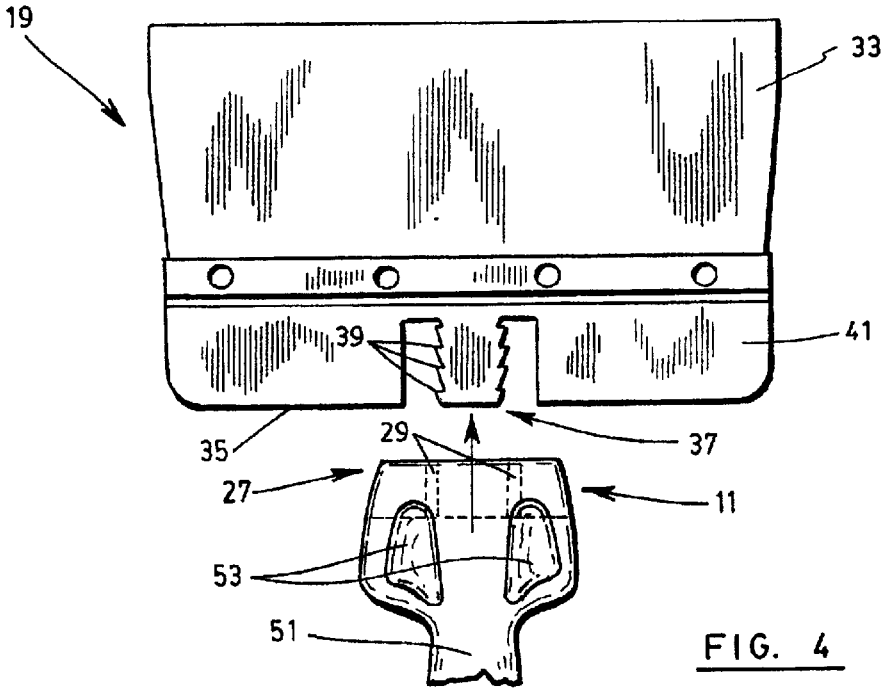
FIG. 4 is an exploded view of the second end and the blade of the drywall knife shown in FIG. 1.

As better shown in FIG. 4, the edge 35 of the blade 19 whose fishbone 37 is inserted into the insertion slot 31 of the front end 11 is preferably the rear edge opposite to the front edge of the blade 19, the latter being primarily used for contacting a work surface (not shown). It is worth noting however that the edge 35 whose fishbone 37 is inserted into the insertion slot 31 need not necessarily be opposite to the working edge, and may be adjacent thereto for example, as apparent to a person skilled in the art. The edge 35 is preferably provided with an extruded reinforcement 41. The extruded reinforcement 41 preferably encases the edge 35 so as to stiffen the blade 19 transversely while allowing longitudinal flexibility. The extruded reinforcement 41 may be attached to the blade 19 by any suitable means, such as welding, riveting, or swaging for example. Preferably also, the blade 19 is made of steel and the extruded reinforcement 41 is made of aluminium.

Figure 2:
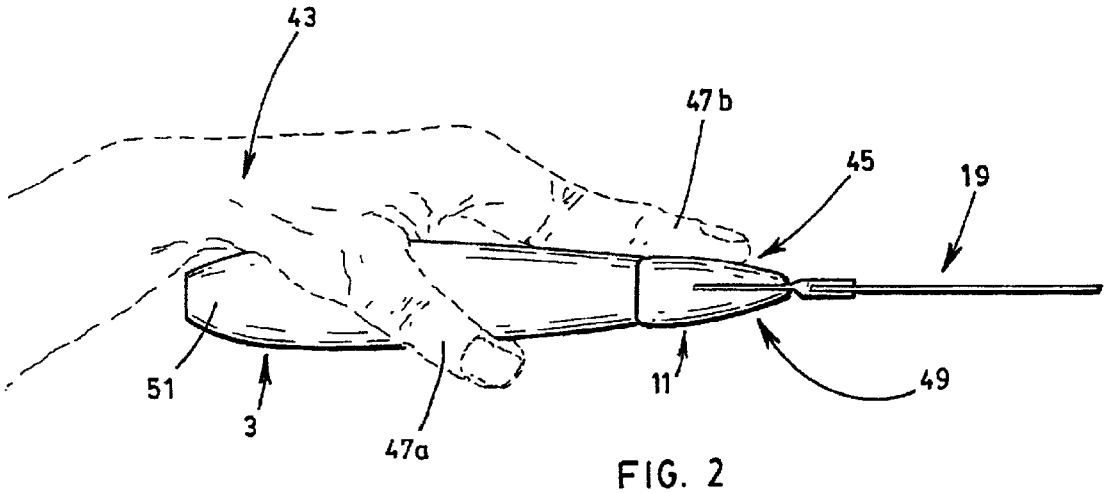
FIG. 2 is a side elevational view of the drywall knife shown in FIG. 1 being held by the hand of a user according to a first preferred hand grip.
Figure 3:
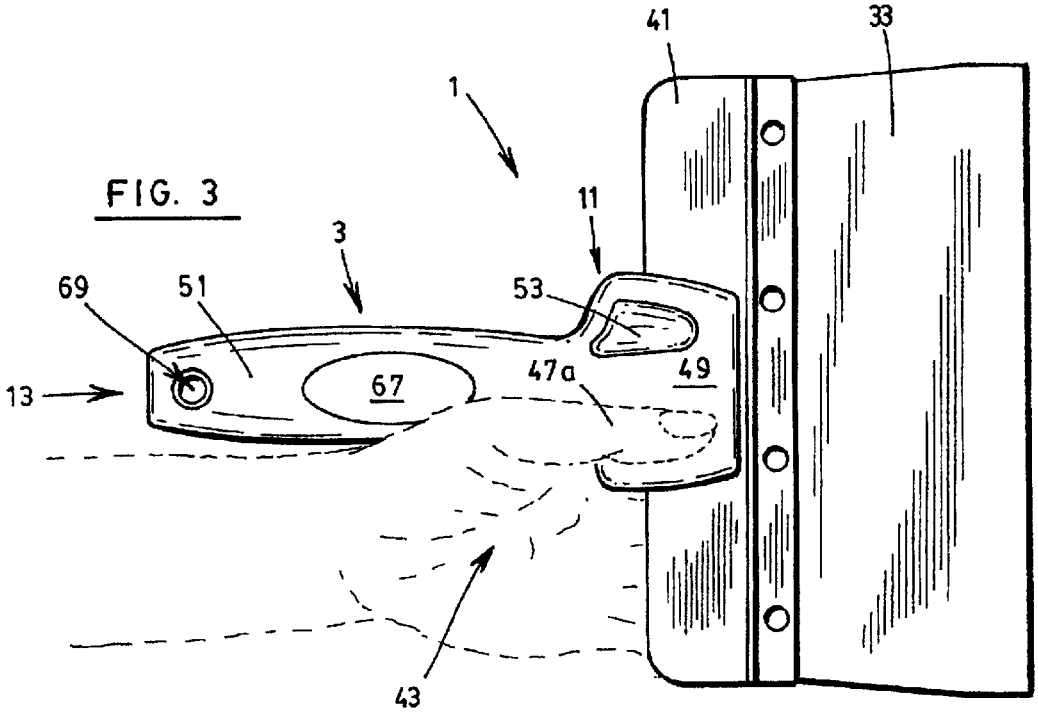
FIG. 3 is a top plan view of the drywall knife shown in FIG. 1 being held by the hand of a user according to a second preferred hand grip.

As better shown in FIGS. 2 and 3, the front end 11 of the inner core 5 is preferably slanted onto the blade 19 in such a manner that a user of the drywall knife 1 can rest his or her hand 43 onto the front end 11 of the inner core 5 and onto the blade 19 in a substantially flat manner. This is primarily intended to allow for a more comfortable hang grip of the drywall knife 1.

As better shown in FIGS. 5 to 7, the inner core 5 preferably comprises a first finger support portion 45 adjacent the front end 11 of the handle 3 on one of the first and second opposite surfaces 15, 17 of the inner core 5 for supporting at least one extended finger 47*a* of a user's hand 43 holding the drywall knife 1. Preferably also, the inner core 5 further comprises a second finger support portion 49 adjacent the front end 11 of the handle 3 on the other one of the first and second opposite surfaces 15, 17 for supporting at least one other extended finger 47*b* of the user's hand 43.

In the preferred embodiment of the invention, the inner core 5 with the lid 23 in folded position is covered with a covering material 51 so as to facilitate hand gripping of the drywall knife 1. The inner core 5 is in use covered with the covering material 51 in such a manner that each finger support portion 45, 49 is left uncovered, as better shown in FIGS. 1, 3 and 4.

It should be understood that although the covering material 51 offers several advantages which are discussed hereinbelow, the drywall knife 1 according to the present invention could adequately be used without the use of a covering material 51, as apparent to a person skilled in the art. However, it is believed that the covering material 51 offers a better and more comfortable hang grip of the drywall knife 1.

Preferably, each finger support portion 45, 49 respectively comprises two finger-shaped recessed cavities 53, each finger support portion 45, 49 being used preferably for alternatively supporting the user's index and middle fingers respectively. More particularly, the same two index and middle fingers 47 of a user's hand 43 can either rest against the finger-shaped recessed cavities 53 of the first finger support portion 45 or those of the second finger support portion 49 so as to operate the drywall knife 1. Furthermore, the drywall knife 1 is preferably symmetrical so as to allow the drywall knife 1 to be operated by a left-hand person or a right-hand person. Moreover, as better shown in FIGS. 2 and 3, the present invention enables various hang grips of the drywall knife 1 such that the at least one finger 47*a* and the at least one other finger 47*b* may be respectively the user's thumb and index fingers 47, as better shown in FIG. 3. For example, as illustrated in FIG. 3, the user's index may rest against a recessed cavity 53 of the first finger support portion 45 while his or her thumb rests on the recessed cavity 53 which is diametrically located on the second finger support portion 49. Moreover, the handle 3 and finger support portions 45, 49 are preferably designed to suggest to unexperienced users the various hang grips which may be adopted so as to ensure proper handling and operating of the drywall knife 1.

According to another embodiment of the invention and as better shown in FIGS. 6 and 7, the second surface 17 of the inner core 5 of the handle 3 is provided with a protuberance 55 comprising an outer surface 57 having at least one groove 59 in the shape of a sign 61. Preferably also, the second surface 17 further comprises at least one channel 63 leading within the inner core 5 to the at least one groove 59, such that when the inner core 5 is covered with the covering material 51, the outer surface 57 of the protuberance 55 is not covered by the covering material 51 and thus remains visible and the at least one channel 63 and the at least one groove 59 of the second surface 17 of the inner core 5 are both filled-up with the covering material 51 to produce the at least one sign 61 on the outer surface 57 of the protuberance 55 of the second surface 17, as better shown in FIG. 1. The sign 61 on the protuberance 55 of the second surface 17 is preferably selected from the group consisting of names, words, numbers, logos, trademarks and symbols conveying information.

Preferably, the inner core 5 is made of polypropylene and the covering material 51 is made of santoprene, and preferably also, the inner core 5 has a colour different from that of the covering material 51 so that the sign 61 produced forms a visual contrast with the protuberance 55 of the second surface 17 of the inner core 5.

As better shown in FIG. 5, the recess 21 preferably comprises two rows each having preferably seven recesses and each row preferably extends along the longitudinal axis 7 of the inner core 5. However, it should be understood, as apparent to a person skilled in the art, that there could be several recesses 21 and that these recesses 21 need not necessarily extend parallel to the longitudinal axis 7 of the inner core 5. As also better shown in FIG. 5, the at least one recess 21 with openings facing the first surface 15 preferably form a set of intersecting ribs 62, thereby allowing a substantially hollow inner core 5 so as to reduce the overall weight of the drywall knife 1 while providing the latter with adequate mechanical properties. It is worth mentioning that the intersecting ribs 62 need not necessarily be orthogonal to one another, and may take on any other various shapes, sizes, and patterns, as apparent to a person skilled in the art, so as to provide the inner core 5, and thus the handle 3, with an adequate longitudinal, transversal, and torsional rigidity, while maintaining a reduced overall weight of the drywall knife 1.

As better shown in FIG. 6, the lid 23 is preferably provided with a protuberance 65 having an outer surface 67. The outer surface 67 is preferably not covered by the covering material 51, as better shown in FIG. 3.

As better shown in FIGS. 5 to 7, the rear end 13 of the inner core 5 preferably comprises a hole 69 extending through the inner core 5 from the first surface 15 to the second surface 17 thereof. The hole 69 is preferably not covered by the covering material 51, as better shown in FIGS. 1 and 3. This hole 69 may be used to hang the drywall knife 1 onto a suitable attachment, as apparent to a person skilled in the art.

Preferably, the front end 11 of the inner core 5 is transversely wider than the rear end 13, as better shown in FIGS. 5 to 7.

As may now be appreciated, the present invention is a substantial improvement over the drywall knives known in the art. Firstly, the ergonomic drywall knife 1 according to the invention is advantageous in that it is inherently lightweight due to its design. The row of recesses 21 and lid 23 assembly of the inner core 5 enable to reduce the overall weight of the handle 3. Furthermore, unlike most of the drywall knives known in the art, the present invention, as explained earlier, comprises a blade 19 which is mounted onto the handle 3 without the use of fasteners, thereby reducing manufacturing parts, assembling steps, and production costs. Another substantial improvement of the present invention over the drywall knives known in the art is that the handle 3 of the present invention is an ergonomic rubberized one enabling comfortable and multiple hand gripping to maximize gripping effort, reduce hand fatigue and give total hand protection. Indeed, the ergonomic rubberized handle 3 maximizes grip and reduces hand fatigue. Furthermore, the recessed curves give total hand protection. Moreover, the built-in cavities 53 allow maximum gripping effort and comfort. Finally, the recessed finger angles maximize flexibility and control.

Of course, numerous modifications could be made to the above-described embodiments without departing the scope of the invention as defined in the appended claims.

What is claimed is:

1. In a drywall knife, said drywall knife comprising:

a handle having an elongated inner core comprising a longitudinal axis, a transverse axis, a front end, a rear end and first and second opposite surfaces extending from the rear end to the front end of the inner core along the longitudinal axis thereof; and a blade securely mounted to the front end of the inner core;

the improvement wherein:

the inner core of the handle comprises rows of recesses extending along the first surface of the inner core each of said recesses having an opening facing said first surface so as to reduce the overall weight of the drywall knife, said recesses further defining a set of intersecting ribs shaped, positioned and sized so as to ensure rigidity of the handle while maintaining said reduced overall weight of the drywall knife, and said inner core further comprises a lid hingedly mounted to the first surface of the inner core, said lid being positioned and sized to be folded about an axis parallel to the longitudinal axis of the inner core so as to cover said rows of recesses, the inner core with the lid in folded position being covered with a covering material so as to facilitate hand gripping of the drywall knife.

2. An ergonomic drywall knife according to claim 1, wherein the front end of the inner core is provided with a slit extending along the transversal axis of the inner core, said slit comprising two shoulders extending parallel to the longitudinal axis of the inner core and defining an insertion slot into which the blade of the drywall knife is securely inserted.

3. An ergonomic drywall knife according to claim 2, wherein the blade of the drywall knife consists of a thin plate having an edge provided with a fishbone comprising toothed edges, said fishbone being devised to be inserted into the insertion slot at the front end of the inner core so that when the fishbone is inserted into said slot, the toothed edges grip into the shoulders and prevent the blade from being removed from the inner core of the drywall knife.

4. An ergonomic drywall knife according to claim 3, wherein the edge of the blade whose fishbone is inserted into the insertion slot of the front end is provided with an extruded reinforcement.

5. An ergonomic drywall knife according to claim 4, wherein the blade is made of steel and the extruded reinforcement is made of aluminum.

6. An ergonomic drywall knife according to claim 1, wherein the front end of the inner core is slanted onto the blade in such a manner that a user of the drywall knife can rest his or her hand onto the front end of said inner core and onto said blade in a substantially flat manner.

7. An ergonomic drywall knife according to claim 1, wherein the inner core comprises a first finger support portion adjacent the front end of the handle on one of said first and second opposite surfaces of the inner core for supporting at least one extended finger of a user's hand holding the drywall knife.

8. An ergonomic drywall knife according to claim 7, wherein the inner core comprises a second finger support portion adjacent the front end of the handle on the other one of said first and second opposite surfaces for supporting at least one other extended finger of the user's hand.

9. An ergonomic drywall knife according to claim 8, wherein the inner core with the lid in folded position is covered with a covering material so as to facilitate hand gripping of the drywall knife, said inner core being covered with said covering material in such a manner that each finger support portion is left uncovered.

10. An ergonomic drywall knife according to claim 9, wherein each finger support portion respectively comprises two finger-shaped recessed cavities, each finger support portion being used for alternatively supporting the user's index and middle fingers respectively.

11. An ergonomic drywall knife according to claim 9, wherein said at least one finger and said at least one other finger are respectively the user's thumb and index fingers.

12. An ergonomic drywall knife according to claim 9, wherein the second surface of the inner core of the handle is provided with a protuberance comprising an outer surface having at least one groove in the shape of a sign, said second surface further comprising at least one channel leading within the inner core to said at least one groove, when said protuberance is placed on said second surface of said inner core such that when the inner core is covered with the covering material, the outer surface of said protuberance is not covered by the covering material and thus remains visible and said at least one channel and said at least one groove of the second surface of the inner core are both filled-up with the covering material to produce said at least one sign on said outer surface of said protuberance of said second surface.

13. An ergonomic drywall knife according to claim 12, wherein the sign on the protuberance of the second surface is selected from the group consisting of names, words, numbers, logos, trademarks and symbols conveying information.

14. An ergonomic drywall knife according to claim 13, wherein the inner core is made of polypropylene and the covering material is made of santoprene, and wherein the inner core has a colour different from that of the covering material so that the sign produced forms a visual contrast with the protuberance of the second surface of the inner core.

15. An ergonomic drywall knife according to claim 9, wherein the rear end of the inner core comprises a hole extending through the inner core from the first surface to the second surface thereof, said hole not being covered by the covering material.

16. An ergonomic drywall knife according to claim 1, wherein said rows of recesses comprise two rows each having seven recesses, each row extending along the longitudinal axis of the inner core.

17. An ergonomic drywall knife according to claim 1, wherein the lid is provided with a protuberance having an outer surface, said outer surface not being covered by the covering material.

18. An ergonomic drywall knife according to claim 1, wherein the front end of the inner core is transversely wider than the rear end.

19. In a drywall knife comprising:

a handle having an elongated inner core comprising a longitudinal axis, a transverse axis, a front end, a rear end and first and second opposite surfaces extending from the rear end to the front end of the inner core along the longitudinal axis thereof; and a blade securely mounted to the front end of the inner core;

the improvement wherein:

the inner core of the handle comprises rows of recesses extending along the first surface of the inner core, each of said recesses having an opening facing said first surfaces so as to reduce the overall weight of the drywall knife, said recesses further defining a set of intersecting ribs shaped, positioned and sized so as to ensure rigidity of the handle while maintaining said reduced overall weight of the drywall knife, said inner core further comprises a lid hingedly mounted to the first surface at the inner core, said lid being positioned and sized to be folded about an axis parallel to the longitudinal axis of the inner core so as to cover said rows of recesses, the inner core with the lid in folded position being covered with a covering material so as to facilitate hand gripping of the drywall knife;

the front end of the inner core is slanted onto the blade in such a manner that a user of the drywall knife can rest his or her hand onto the front end of said inner core and onto said blade in a substantially flat manner;

the inner core comprises a first finger support portion adjacent the front end of the handle on one of said first and second opposite surfaces of the inner core for supporting at least one extended finger of a user's hand holding the drywall knife;

the inner core comprises a second finger support portion adjacent the front end of the handle on the other one of said first and second opposite surfaces for supporting at least one other extended finger of the user's hand, each finger support portion respectively comprising two finger-shaped recessed cavities;

the inner core with the lid in folded position is covered with a covering material so as to facilitate hand gripping of the drywall knife, said inner core being covered with said covering material in such a manner that each finger support portion is left uncovered; and the front end of the inner core is transversely wider than the rear end.

* * * * *